US005620049A

United States Patent [19]

Gipson et al.

[11] Patent Number: 5,620,049

[45] Date of Patent: Apr. 15, 1997

[54] METHOD FOR INCREASING THE PRODUCTION OF PETROLEUM FROM A SUBTERRANEAN FORMATION PENETRATED BY A WELLBORE

[75] Inventors: Larry J. Gipson, Anchorage, Ak.; Carl T. Montgomery, Plano, Tex.

[73] Assignee: Atlantic Richfield Company, Los Angeles, Calif.

[21] Appl. No.: 572,630

[22] Filed: Dec. 14, 1995

[51] Int. Cl.[6] ..... F21B 43/24; F21B 43/25; F21B 43/267

[52] U.S. Cl. ..... 166/248; 166/50; 166/280; 166/281; 166/288; 166/295; 507/924

[58] Field of Search ..... 166/65.1, 50, 248, 166/280, 281, 288, 295, 302, 308; 507/924

[56] References Cited

U.S. PATENT DOCUMENTS

| | | | |
|---|---|---|---|
| 3,547,193 | 12/1970 | Gill | 166/248 |
| 3,659,651 | 5/1972 | Graham | 166/280 |
| 4,030,549 | 6/1977 | Bouck | 166/280 |
| 4,567,945 | 2/1986 | Segalman | 166/248 |
| 4,705,108 | 11/1987 | Little et al. | 166/280 X |
| 4,785,884 | 11/1988 | Armbruster | 166/280 |
| 5,339,898 | 8/1994 | Yu et al. | 166/248 |
| 5,520,250 | 5/1996 | Harry et al. | 166/280 X |

OTHER PUBLICATIONS

Conexpo Arpel '92 Brochure, Oct. 18–23, 1992, 3rd Latin American Petroleum Congress, 3rd Latin American Exposition of Equipment and Services for the Oil and Petrochemical Industry with reference.

"Volumetric in Situ Electrical Heating: An Unexploited Electrotechnology", J. E. Bridges, IIT Research Institute, Chicago, Illinois, 8 pgs.

"A Test of the Electric Heating Process as a Means of Stimulating the Productivity of an Oil Well in the Schoonebeek Field", S. A. Rice, A. L. Kok and C. J. Neate, 11 pgs.

"A Preview of an Electromagnetic Heating Project", Gregory A. Romney, Arthur Wong and James H. McKibbon, Petroleum Society of CIM and Aostra, 13 pgs.

Minutes of Meeting on Apr. 12, 1995, SIPM Headquarters, The Hague, Holland on Jun. 5, 1995, 4 pgs.

"Initial Experience with ESP's On the Alaskan North Slope", J. H. Andrew and B. G. Augustine, 10 pgs.

Brochure on "Stop Paraffin Build-up and Realize Your Well's Full Potential", Plug In Patrol™, 5 pgs.

A Production Technologies International Inc. Reprint from the Jan. 1989 issue of *Petroleum Engineer,* "New System Stops Paraffin Buildup", 4 pgs.

*Oil & Gas Journal,* Apr. 18, 1994, reprint, "Electic Tubing Heater Improves Well Production in CO2 Flood", 2 pgs.

*World Oil,* May 1970, "AC Current Heats Heavy Oil for Extra Recovery", article, 4 pgs.

*The American Oil & Gas Reporter,* Mar. 1992, Special Report: Production Enhancement, 4 pgs.

Preprint of"A Test of the Electric Heating Process as a Means of Stimulating The Productivity of an Oil Well in the Schoonebeek Field", *Petroleum Society of CIM,* Paper No. 92–04, 16 pgs.

(List continued on next page.)

*Primary Examiner*—George A. Suchfield
*Attorney, Agent, or Firm*—F. Lindsey Scott

[57] ABSTRACT

According to the present invention, the production of petroleum from a petroleum-bearing subterranean formation penetrated by a wellbore is accomplished by (a) fracturing the subterranean formation and injecting a conductive proppant into the fracture, the conductive proppant comprising particles which are at least partially coated with a heat hardenable, conductive resin to create a fluidly and electrically conductive fracture in the formation; (b) passing an electrical current into the formation through the wellbore to heat the formation and harden the conductive resin thereby at least partially aggregating the particles and retaining the particles in the fracture and heating the fracture and the subterranean formation in the vicinity of the fracture.

15 Claims, 2 Drawing Sheets

OTHER PUBLICATIONS

Preprint of"Electromagnetic Stimulation of Lloydminster Heavy Oil Reservoirs; Field Test Results", *Petroleum Society of CIM and AOSTRA,* Paper No. 91–31, 17 pgs.

*SPE*, "Improved Calculation of Oil Production Response to Electrical Resistance Heating (ERH)", B. A. Baylor, J.B. Maggard and R. A. Wattenbarger, for presentation at the 65th Annual Technical Conference and Exhibition of the SPE in New Orleans, LA, Sep. 23–26, 1990.

*SPE*, "Feasibility of Reservoir Heating by Electromagnetic Irradiation", J. R. Fanchi, for presentation at the 65th Annual Technical Conference and Exhibition of the SPE in New Orleans, LA, Sep. 23–26, 1990.

*SPE*, "Electric Heating of Oil Reservoirs: Numerical Simulation and Field Test Results", for presentation at the 65th Annual Technical Conference and Exhibition of the SPE in San Antonio, TX, Oct. 8–11, 1989.

Paper PID 91–14 for presentation at the 1990 Petroleum and Chemical Industry Technical Conference, Houston, TX, Sep. 10–12 "Evaluation of Downhole Electric Impedance Heating Systems for Paraffin Control in Oil Wells".

Paper No. 851–37–C, "A High Strength Glass Pellet as a Fracture–Propping Agent", for presentation at the Spring Meeting of the Mid–Continent District Division of Production, Amarillo, Texas, Mar. 27–29, 1963.

SPE 6213 Text, "Fracturing With a High–Strength Proppant", Oct. 1977, 2 pgs.

SPE 1131 Text, "Relation of Formation Rock Strength to Propping Agent Strength in Hydraulic Fracturing", 2 pgs.

SPE 48 Text, Stimulation of Deep Gas and Gas–Distillate Wells, 2 pgs.

SPE 10132 Text, "The Comparative Effectiveness of Propping Agents in the Red Fork Formation of the Anadarko Basin", 2 pgs.

*Journal of Petroleum Technology*, "Propping Fractures with Aluminum Particles", paper presented at 35th Annual Fall Meeting of SPE, Oct. 2–5, 1960, in Denver, 7 pgs.

*The Oil and Gas Journal*, Jul. 3, 1961, "How to design a fracture treatment", 5 pgs.

*The Petroleum Engineer*, Nov., 1960, "New Fracture Propping Process Uses Aluminum Pellets", 3 pgs.

Brochure of Fountain Oil, Houston, Texas, 12 pgs.

METHOD FOR INCREASING THE PRODUCTION OF PETROLEUM FROM A SUBTERRANEAN FORMATION PENETRATED BY A WELLBORE

BACKGROUND OF THE INVENTION

This invention relates to a method for increasing the production of petroleum from subterranean formations containing heavy petroleum by use of fluid and electrical current conductive fractures in such formations.

Many oil-bearing formations are tight formations which do not permit the flow of oil from the formation into a wellbore at an acceptable rate.

When such formations are consolidated, fracturing with or without the use of proppants may be effective to increase the flow of petroleum from the formations. In some such formations, the petroleum is heavy and even when open fractures exist, the oil does not flow from the formation at an acceptable rate because of its high viscosity. Electrical heating of the formation in the vicinity of the wellbore has been used to increase the production of oil from such formations. In some instances, such electrical heating has been achieved by the use of electrically conductive proppants positioned in the fracture. Unfortunately, quantities of the proppant may be produced from the fracture with the viscous oil or redistributed in the fracture by the flow of the heavy oil from the formation. In such instances, both the electrical and the fluid conductivity of the fracture can be reduced or lost.

Other formations may be unconsolidated. Fracturing is less effective with such formations since the fractures tend to close when the fracturing pressure is removed. Proppants are less effective with such fractures since the proppant can become imbedded or enclosed by the unconsolidated formation either immediately or over time. It is desirable that methods be available to produce viscous oils from such formations. Conductive proppants and electrical heating have also been used in such formations in an attempt to increase the production of viscous oil. In such unconsolidated formations, sand or other unconsolidated material may also be produced with the oil. The proppant may be redistributed or lost or the fractures may be plugged by the migration of sand into the fracture containing the proppants during production of the viscous oil.

In both instances, both the fluid and the electrical conductivity of the proppant may be reduced or lost as a result of the redistribution or production of the proppant.

Accordingly, a continuing effort has been directed to the development of methods for positioning and maintaining a fluidly conductive and electrically conductive fracture in an oil-bearing formation.

SUMMARY OF THE INVENTION

According to the present invention, the production of petroleum from a petroleum-bearing subterranean formation penetrated by a wellbore is accomplished by (a) fracturing the subterranean formation and injecting a conductive proppant into the fracture, the conductive proppant comprising particles which are at least partially coated with a heat hardenable, electrically conductive resin, to create a fluidly and electrically conductive fracture in the formation; (b) passing an electrical current into the formation through the wellbore to heat the formation and harden the conductive resin thereby at least partially aggregating the particles and retaining the particles in the fracture and heating the subterranean formation in the vicinity of the fracture.

DESCRIPTION OF PREFERRED EMBODIMENTS

In the discussion of the Figures, the same numbers will be used throughout to refer to the same or similar elements.

Figure 1:
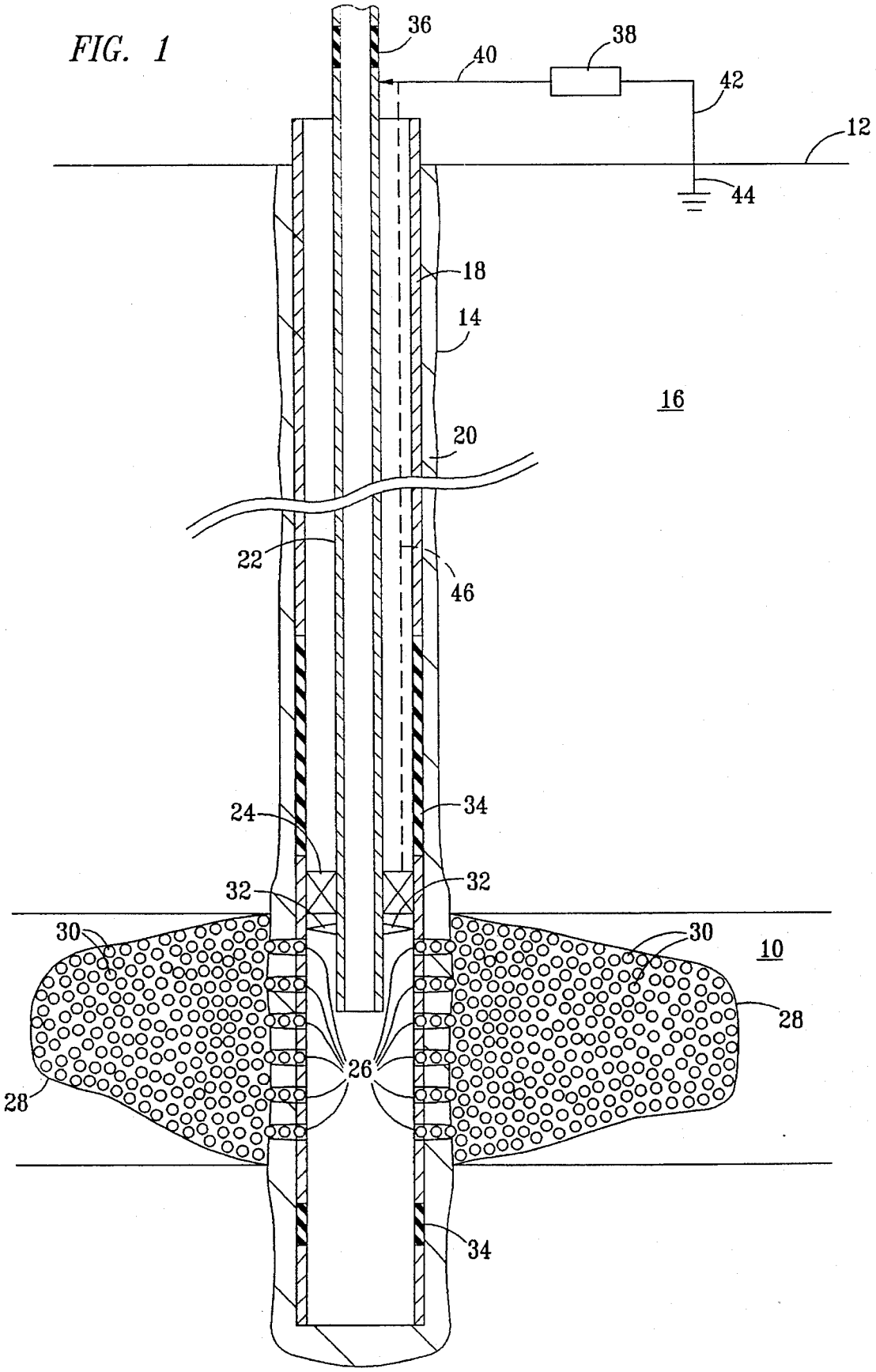
FIG. 1 is a schematic diagram of a wellbore extending from the surface of the earth into a subterranean petroleum-bearing formation with a proppant-filled fracture extending from the wellbore into the formation.

In FIG. 1, an oil-beating formation 10 is penetrated from a surface 12 by a wellbore 14 which extends from the surface 12 through an overburden 16 to the subterranean formation 10. The wellbore 14 is cased with a casing 18 which is cemented in place by cement 20. The cement 20 extends along the entire length of the casing 18 and into a lower portion of casing 18. A tubing 22 is also positioned in the wellbore 14 and extends from the surface 12 into the formation 10. A packer 24 is positioned between an outer diameter of the tubing 22 and an inner diameter of the casing 18 near a top of the formation 10. The tubing 22 terminates in the vicinity of a plurality of perforations 26 through the casing 18 and the cement 20. Desirably, the formation 10 is fractured by a plurality of fractures 28, two of which are shown as generally vertical fractures. According to the method of the present invention, the fractures 28 are substantially filled with proppant particles 30. In order to introduce electrical current into the fractures 28, a contactor 32 is positioned on a lower portion of the tubing 22 and current is passed through the tubing 22 and the contractor 32 into the formation 10. To insure that the electrical current passes into the fractures 28, the casing 18 includes insulated sections 34 positioned above the contactor 32 and below the perforations 26. Desirably, the packer 24 is also conductive between the casing 18 and the tubing 22. The tubing 22 also contains an insulated tubing section 36 to insure that electrical current passed to the tubing 22 passes through the tubing and the contactor 32 and into the fractures 28. An electric power supply 38 is provided for supplying power via a line 40 to the tubing 22 with the electric power supply 38 being grounded via a line 42 to a ground 44. Alternatively, electrical power may be supplied to the fractures 28 via a line 46 (shown as a dotted line) which conducts electrical power directly to the packer 24 and then through the casing 18 into the fractures 28. The well shown in FIG. 1 includes necessary equipment (not shown) at the surface for producing fluids from the formation 10 via the tubing 22. A pump may be positioned on the lower end of the tubing 22, if necessary, to pump the petroleum to the surface 12.

The completion and operation of such wells to electrically heat subterranean formations is considered to be known to those skilled in the art, and many of the features shown in FIG. 1 are known to those skilled in the art.

Figure 2:
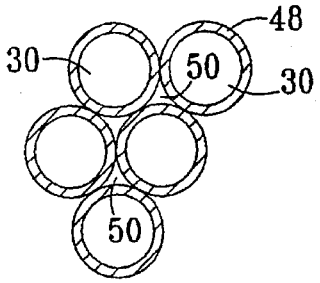
FIG. 2 shows a cross-sectional view of a plurality of proppant particles as positioned in the fractures shown in FIG. 1.

In FIG. 2, an enlarged view of the proppant particles 30 according to the present invention is shown. Proppant particles 30 include a heat hardenable conductive resin coating 48 on their exterior surfaces so that when the proppant particles 30 are placed in close contact in the fractures 28, the conductive heat hardenable resin surfaces 48 are in contact with each other. A plurality of openings 50 are formed between the proppant particles 30. When electrical energy is passed into the fractures 28, the heat hardenable resin first softens and adheres to surrounding particles and then hardens to aggregate the proppant particles 30 into an aggregated porous mass of proppant particles which are thereby fixed in place in the fracture 28. This provides a conductive and porous passageway for fluid production from the fractures 28 through the openings 50 in the aggregated proppant particles and for conducting electrical current into the formation 10. The aggregated particles are also much less susceptible to the invasion of sand particles from unconsolidated formations. The aggregated particles are much more strongly retained in the fracture 28 notwithstanding the flow of heavy hydrocarbons from the fractures 28. Particles precoated with conductive resins and typically set up to a temperature of about 135° F. are commercially available. A variety of particulate materials coated with a variety of conductive resins is available.

Figure 3:
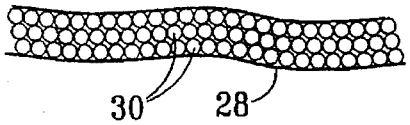
FIG. 3 shows a cross-sectional view of a portion of a proppant-filled fracture in a consolidated formation.

In FIG. 3, aggregated particles are shown in position in the fracture 28 in a consolidated formation.

Figure 4:
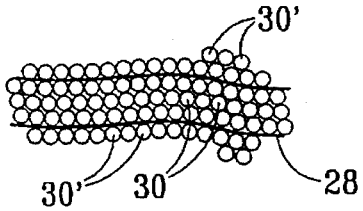
FIG. 4 shows a cross-sectional view of a portion of a proppant-filled fracture with proppant embedment in an unconsolidated formation.

In FIG. 4, a section of the fracture 28 in an unconsolidated formation is shown. A portion of the proppant particles 30 shown as proppant particles 30' have been embedded in the unconsolidated material surrounding the fracture 28. The proppant particles 30', when subjected to electric current, tend to aggregate to a slight extent with the unconsolidated material surrounding the fracture 28. These particles tend to inhibit the movement of sand and other finely divided, unconsolidated material into the fracture 28, thereby further facilitating the production of petroleum fluids from the fractures 28. The particles 30 in fracture 28 are aggregated as discussed above.

Figure 5:
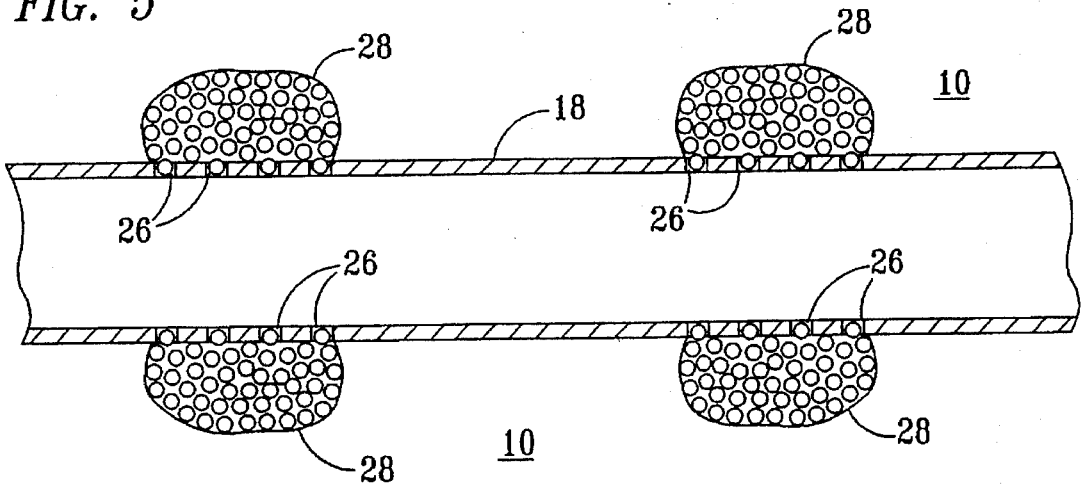
FIG. 5 is a schematic diagram of proppant-filled fractures extending from a section of a horizontal wellbore.

The fractures containing the conductive proppant according to the present invention may be formed in deviated or horizontal wells. Fractures extending from a horizontal well section are shown in FIG. 5. The associated packing, conductors, tubing and the like are considered to be known to the art and have not been shown.

As noted previously, the use of electrical energy to heat subterranean formations is known to the art. Many of the features shown in FIG. 1 are known to those skilled in the art, and no novelty is claimed therein, except in conjunction with the use of the heat hardenable electrically conductive resin on the exterior of the proppant particles.

The proppant particles may be conductive particles selected from the group consisting of conductive metals, conductive metal alloys, conductive metal oxides, conductive metal salts, and combinations thereof. Desirably, these particles are coated with a heat hardenable electrically conductive resin which, upon heating, softens and bonds to the adjoining particles and then hardens to aggregate the particles together in a coarse aggregate which fixes the particles in place in the fracture and provides a flow path for fluids within the aggregated particles in the fracture. One particularly suitable metal is aluminum.

The proppant particles may also be non-conductive. Suitable non-conductive materials are materials such as substantially non-conductive ceramics, glass, sands, non-conductive inorganic oxides, non-conductive inorganic resins, non-conductive polymers and combinations thereof.

The particles are at least partially, and preferably, substantially completely coated with a heat hardenable electrically conductive resin. The resin is present in an amount sufficient to consolidate the proppant particles but insufficient to fill the openings between the particles. Normally, the resin is present in an amount equal to from about 0.5% to about 6.0% based upon the weight of the proppant particles. Preferably, the resin is present in an amount equal to from 2 to 4 percent based upon the weight of the proppant particles.

Typically, the proppant particles have an average particle size from about 60 to about 8 Tyler mesh. A correlation between Tyler mesh and particle diameter in inches is shown in "Propping Fractures with Aluminum Particles," L. R. Kern, T. K. Perkins and R. W. Wyant, *Journal of Petroleum Technology*, 583–588, June 1961. Larger or smaller particles can be used if required by the particular application.

The heat hardenable electrically conductive resin can comprise any one of a number of suitable resins mixed with finely divided, conductive material to obtain the desired degree of conductivity. One particularly suitable conductive resin comprises phenol formaldehyde resin containing finely divided graphite which is heat hardenable at temperatures above about 135° F.

The method of the present invention is particularly advantageous in petroleum-containing formations wherein the petroleum is a viscous petroleum which does not flow at an acceptable rate from the formation in the absence of heating or other treatment, particularly where the formation is an unconsolidated formation. The term "petroleum" as used herein refers to both gaseous and liquid hydrocarbons. While the present invention is particularly effective with viscous liquid petroleum containing formations, it is also effective in other formations with proppant flow-back problems such as lighter petroleum and gas containing formations. Preferably, the formations treated have an initial temperature below about 135° F.

According to the present invention, conductive proppants are positioned in a fracture in a subterranean petroleum-bearing formation to produce a fracture which is both fluidly and electrically conductive and which is stable and remains useful over an extended period of time to produce fluids from the subterranean formation by heating the fracture and the formation by the use of electrical energy passed into the formation through the electrically conductive fracture.

The equipment used to pass electricity into such fractures is well known to those skilled in the art and will not be discussed further except to note that the contactor 32 can be an induction contactor, or alternatively, conductive packs of conductive particles could be used at the outlet of the fractures 28 and the like. Similarly, contact with the fractures 28 may be made through the casing 18.

Having thus described the present invention by reference to certain of its preferred embodiments, it is pointed out that the embodiments described are illustrative rather than limiting, and that many variations and modifications may appear obvious and desirable to those skilled in the art based upon a review of the foregoing description of preferred embodiments.

What is claimed is:

1. A method for increasing the production of petroleum from a petroleum containing subterranean formation penetrated by a wellbore, the method comprising a) fracturing the subterranean formation and injecting an electrically conductive proppant into the fracture, the conductive proppant comprising particles which are at least partially coated with a heat hardenable, conductive resin to create a fluidly and electrically conductive fracture in the formation;and b) passing an electrical current into the formation through the wellbore to heat the formation and harden the conductive resin thereby at least partially aggregating the particles and retaining the particles in the fracture and heating the subterranean formation in the vicinity of the fracture.

2. The method of claim 1 wherein the particles are conductive.

3. The method of claim 2 wherein the particles are of a material selected from the group consisting of conductive metals, conductive metal alloys, conductive metal oxides, conductive metal salts, and combinations thereof.

4. The method of claim 3 wherein the particles are aluminum pellets.

5. The method of claim 1 wherein the particles are non-conductive.

6. The method of claim 5 wherein the particles are of a material selected from the group consisting of ceramics, glass, sands, inorganic oxides, organic resins and polymers and combinations thereof.

7. The method of claim 1 wherein the particles are substantially completely coated with the heat hardenable electrically conductive resin.

8. The method of claim 7 wherein the resin is present in an amount sufficient to consolidate the particles but insufficient to fill openings between the particles.

9. The method of claim 8 wherein the particles have an average particle size from about 60 to about 8 Tyler mesh.

10. The method of claim 9 wherein the conductive resin comprises a phenol formaldehyde resin containing graphite which is heat hardenable at temperatures above about 135° F.

11. The method of claim 10 wherein the conductive resin is present in an amount equal to from about 0.5 to about 6.0 weight percent based upon the weight of the proppant.

12. The method of claim 1 wherein the formation includes a viscous petroleum.

13. The method of claim 1 wherein the formation is unconsolidated.

14. The method of claim 1 wherein the formation contains hydrocarbon gases.

15. The method of claim 1 wherein the initial formation temperature is less than about 135° F.

* * * * *